US007832029B2

(12) United States Patent
Holtsnider

(10) Patent No.: US 7,832,029 B2
(45) Date of Patent: Nov. 16, 2010

(54) BALL PULSATING HYDROTHERAPY JET

(75) Inventor: Michael D. Holtsnider, Moorpark, CA (US)

(73) Assignee: B & S Plastics, Inc., Oxnard, CA (US)

( * ) Notice: Subject to any disclaimer, the term of this patent is extended or adjusted under 35 U.S.C. 154(b) by 464 days.

(21) Appl. No.: 11/501,947

(22) Filed: Aug. 9, 2006

(65) Prior Publication Data

US 2007/0033725 A1 Feb. 15, 2007

Related U.S. Application Data

(60) Provisional application No. 60/707,427, filed on Aug. 9, 2005.

(51) Int. Cl.
*A61H 33/04* (2006.01)

(52) U.S. Cl. ..... 4/541.6; 239/382

(58) Field of Classification Search ..... 4/541.6; 239/382

See application file for complete search history.

(56) References Cited

U.S. PATENT DOCUMENTS

| | | | | | |
|---|---|---|---|---|---|
| 2,086,515 | A * | 7/1937 | Evans | 239/246 |
| 3,771,723 | A * | 11/1973 | Ray | 239/206 |
| 4,089,471 | A * | 5/1978 | Koenig | 239/381 |
| 4,320,541 | A | 3/1982 | Neenan | 4/492 |
| 4,456,174 | A | 6/1984 | Neenan | 239/8 |
| 4,781,328 | A * | 11/1988 | Robertson | 239/230 |
| 4,927,082 | A * | 5/1990 | Greenberg et al. | 239/230 |
| 5,014,372 | A | 5/1991 | Thrasher et al. | 4/542 |
| 5,269,029 | A | 12/1993 | Spears et al. | 4/641.6 |
| 5,353,447 | A * | 10/1994 | Gravatt | 4/541.6 |
| 5,689,896 | A * | 11/1997 | Smetana | 34/97 |
| 5,920,925 | A | 7/1999 | Dongo | 4/541.6 |
| 6,491,238 | B1 * | 12/2002 | Swanson et al. | 4/541.6 |
| 6,848,637 | B2 * | 2/2005 | Holtsnider | 239/587.1 |
| 2003/0226199 | A1 * | 12/2003 | Holtsnider | 4/541.6 |

OTHER PUBLICATIONS

Waterway Plastics, Inc. 2006 Product Catalog, pp. 5-26.

* cited by examiner

*Primary Examiner*—Gregory L Huson
*Assistant Examiner*—Karen Younkins
(74) *Attorney, Agent, or Firm*—Koppel, Patrick, Heybl & Dawson

(57) ABSTRACT

A hydrotherapy jet for providing a pulsating water stream comprises a jet body, and a water inlet to allow a stream of water into the body. A water outlet allows the stream to exit the body and a movable ball within the body causes said stream of water to pulsate as it exits the body.

26 Claims, 7 Drawing Sheets

FIG. 3
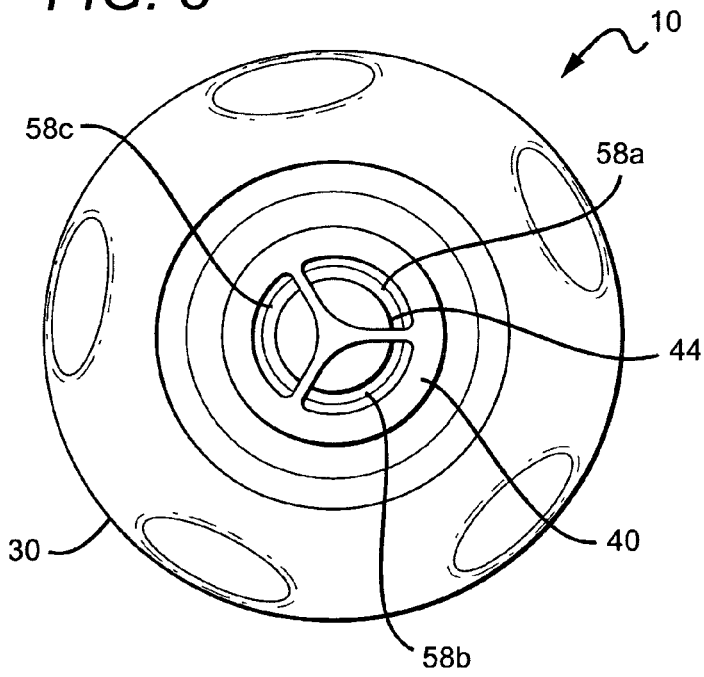
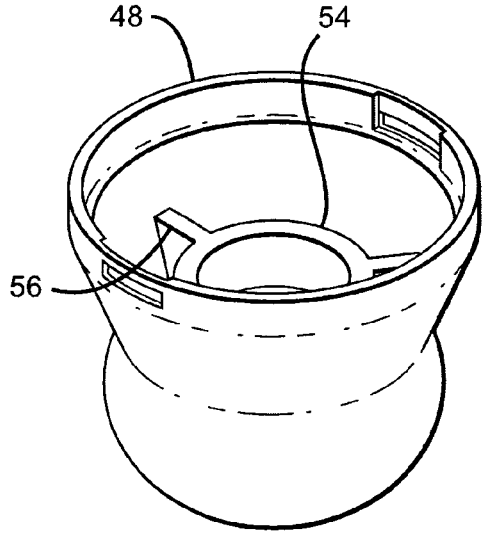
FIG. 6
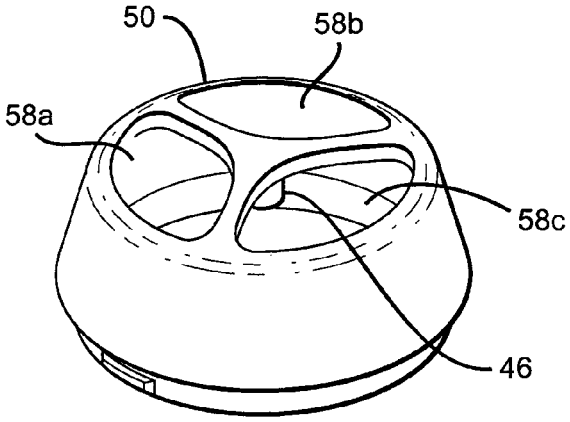
FIG. 7

BALL PULSATING HYDROTHERAPY JET

This application claims the benefit of provisional application Ser. No. 60/707,427 to Holtsnider, which was filed on Aug. 9, 2005.

BACKGROUND OF THE INVENTION

1. Field of the Invention

This invention relates to hydrotherapy jets and more particularly to hydrotherapy jets generating a pulsating water stream by the action of an internal ball.

2. Description of the Related Art Various hydrotherapy jets have been developed for use in spas, hot tubs, pools, bath tubs and the like ("spa"). Jets can be arranged to discharge a stream of water to the interior of the spa, which can be aerated through a variety of commercially available discharge nozzles. The various designs provide different flow characteristics that produce a pleasing massaging effect for the spa occupants, and have become quite popular. In the design of single or multi-user spas or tubs, it is common to use a variety of different jet nozzles to provide a variety of different massaging effects.

Early jets simply discharged a stream of warm water with aeration if desired, along the longitudinal axis of the jet body. Since then, numerous jets have been developed in which the direction of the stream can be adjusted. For example, U.S. Pat. No. 5,269,029 to Spears et al. (assigned to the same assignee as the present invention) discloses a jet that provides an off axis stream of water and has an axial push/pull mechanism used to control the flow of water. The mechanism can also be rotated to rotate the stream of water around the jet axis, providing a limited directional control over the stream.

Other jets have been developed having fully adjustable directional outlets or eyeballs, which are typically mounted in the face plate of the jet or recessed within the jet body. See Waterway Plastics Inc., "2006 Product Catalog", pages 5-26. For some of these jets, the direction of the stream of water can be adjusted by manually manipulating the nozzle or eyeball to the desired direction.

Still other jets have been developed that produce a pulsating stream of water. U.S. Pat. No. 4,456,174 to J. Neenan, discloses a spa jet that produces a pulsating action by having a rotating flow disturbing blade mounted at the discharge end of the jet nozzle. Water flowing through the jet turns a small multi-bladed turbine that then turns a disturbing vane that is positioned to disturb the jet's water flow through part of the vane's rotation. The rotating velocity of the disturbing vane can be controlled and the amount of projection of the turbine rotor into the water stream can also be varied.

U.S. Pat. No. 4,320,541 also to J. Neenan, discloses a spa jet that provides a pulsating action by a flow impeding spoiler that momentarily and repetitively disturbs the water jet that is projected into a mixing chamber. Disturbing the jet effectively disables the vacuum produced by the venturi action, which causes a discharge of a water stream of decreased velocity having considerably less entrained air.

U.S. Pat. No. 5,014,372 to L. Thrasher et al. discloses a hydrotherapy jet that produces rotating and pulsating streams of water. The jet includes a nozzle rotor that rotates within the jet body and is held by a rotor retainer cage. The nozzle rotor has two passageways and turns in response to the jet water passing through the passageways. A portion of the retainer cage extends over the discharge end of the rotor so that water from the rotor passageways is momentarily interrupted as the rotor turns.

U.S. Pat. No. 5,920,925 to Dongo, (assigned to the same assignee as the present invention) discloses a spa jet having a rotating eyeball and a diverter cap formed with a number of bore holes positioned at a common radius from the center of the cap. Water flowing through passageways in the eyeball causes it to rotate at a high speed. The water discharging from the passageways intersects with the diverter cap boreholes to produce the sensation of a number of simultaneously pulsating water jets.

SUMMARY OF THE INVENTION

One embodiment of a hydrotherapy jet system according to the present invention that provides a pulsating water stream comprises a jet body, and a water inlet to allow a stream of water into the body. A water outlet allows the stream to exit the body and a movable ball within the body causes the stream of water to pulsate as it exits the body.

Another embodiment of hydrotherapy jet system that provides a pulsating water stream according to the present invention comprises a jet body and a stream of water flowing through the body. A movable object within the jet body blocks and diverts the stream, with the stream pulsating as it leaves the body.

One embodiment of a system for providing a hydrotherapy jet to a reservoir of water according to the present invention comprises a reservoir shell capable of holding water and a plurality of hydrotherapy jets mounted to the reservoir shell. A water pump system circulates water from the reservoir and is capable of providing a stream of water to at least one of the jets having an internal object that moves within the body to block and divert the stream. The jet provides a pulsating stream to the reservoir.

These and other further features and advantages of the invention would be apparent to those skilled in the art from the following detailed description, taken together with following drawings:

BRIEF DESCRIPTION OF THE DRAWINGS

FIG. 3 is a top view of the jet shown in FIG. 1;

FIG. 6 is a perspective view of the lower eyeball used in the jet shown in FIGS. 1-5;

FIG. 7 is a perspective view of the upper eyeball used in the jet shown in FIGS. 1-5;

DETAILED DESCRIPTION OF THE INVENTION

Figure 2:
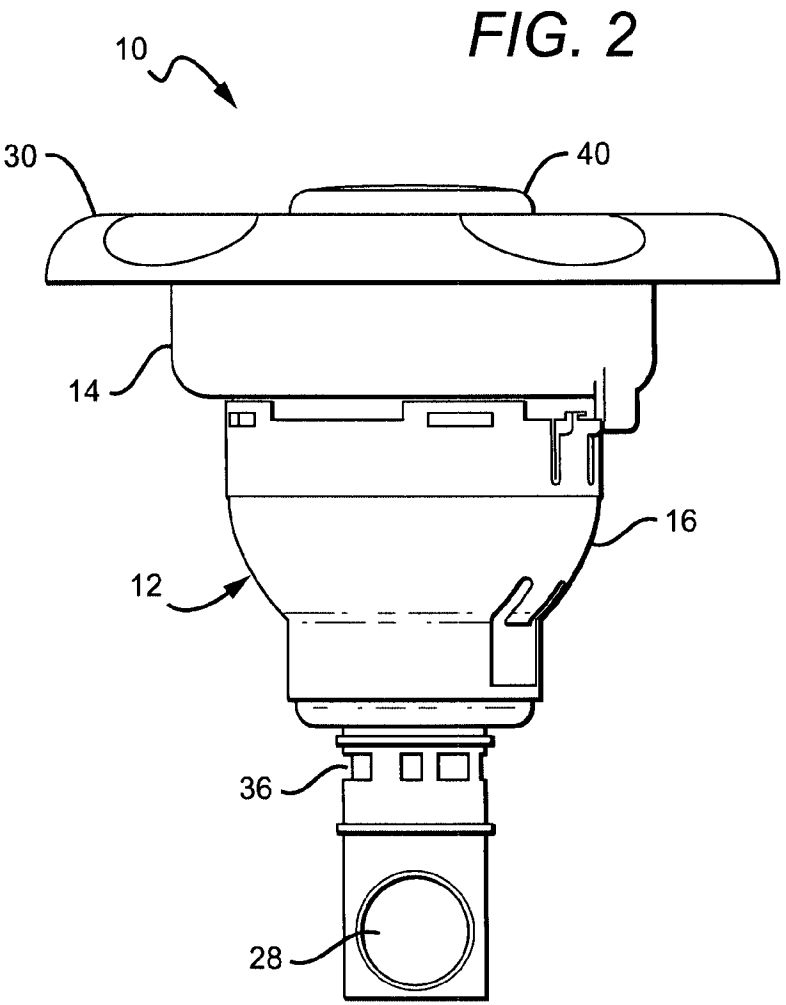
FIG. 2 is an elevation view of the jet shown in FIG. 1.
Figure 1:
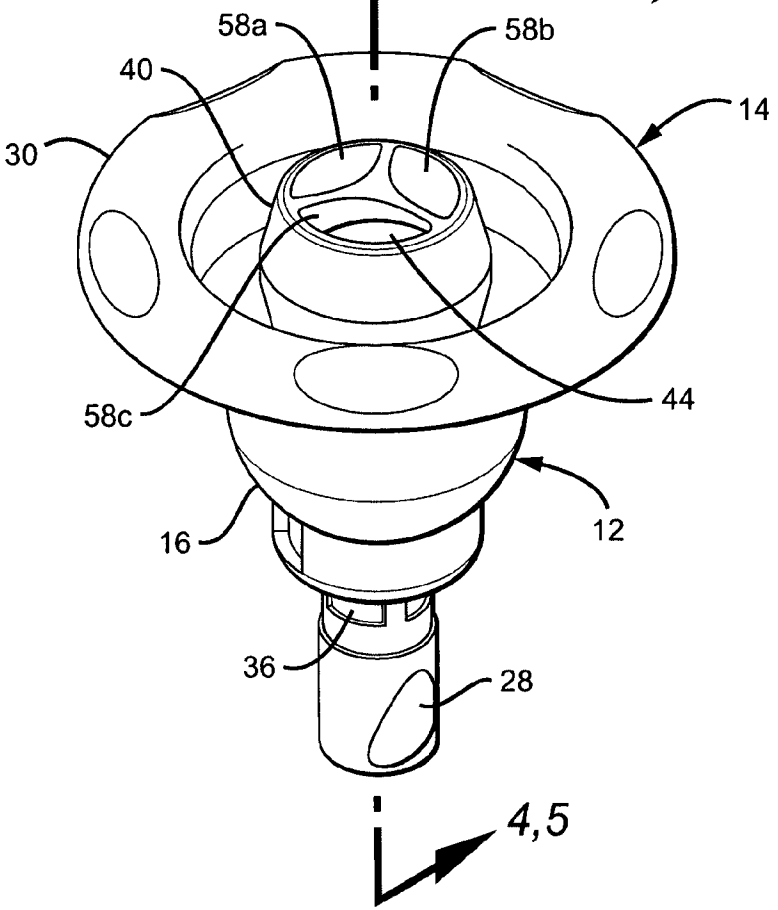
FIG. 1 is a perspective view of one embodiment of a hydrotherapy jet according to the present invention.

The present invention generally provides a spa hydrotherapy jet having an internal object that is free to move about within the jet body to mechanically block or divert the stream of water passing through the jet. This mechanical diversion causes the sensation for the spa occupant that the stream of water from the jet is pulsating.

Many different objects having many different shapes can be used, including but not limited to cubic, diamond, pyramid and egg shaped objects. In one embodiment, the preferred object has a substantially spherical shape ("ball") and is made of. plastic, such as ABS of PVC, or rubber materials, although other materials can also be used. In some embodiments, a rubber ball may be preferable to reduce noise caused from the ball moving within the jet. During operation, the ball is operated on and moved by the stream of water passing through the jet to cause the jet to generate a pulsating stream.

The jet according to the present invention generally comprises a housing having a water inlet to accept a stream of water and an outlet to provide a stream of water from the jet housing to the interior of a spa. The. jet outlet can comprise a number of outlet openings, although in some embodiments it can comprise a single opening. An internal ball is held in the jet in a space sized to allow the ball to move about within the housing. The stream of water passing through the jet from the water inlet to the water outlet contacts the internal ball, causing it to move about within its housing space. This movement causes the ball to at least partially block at least one of the outlet openings, causing at least a partial interruption of the water exiting from at least one of said openings. The blocking action provides a pulsing effect of the water stream exiting from the water outlet openings. In the case of an outlet having a single opening, the movement of the internal ball at least partially blocks and unblocks the water as it passes out of the outlet, which provides a pulsating action.

This arrangement of the present invention provides simpler and more reliable pulsating jets. The number of moving parts is reduced and there are no bearing or pins holding moving parts within the jet. This reduces the number of parts that can fail and provides for a jet that can be manufactured at lower costs.

FIGS. 1-5 show one embodiment of the hydrotherapy jet 10 constructed in accordance with the present invention. The jet 10 and its components are preferably formed from a water impervious plastic such as ABS although it is understood that other materials can also be used. The components are formed using conventional plastic fabrication processes, such as injection molding. As mentioned above, the ball can be formed of many materials but in the embodiment shown is made of a rubber material to reduce noise. The jet 10 is particularly adapted to be mounted to the wall of a spa, just below the water line, with the majority of the jet positioned behind the spa's water contacting wall.

Figure 4:
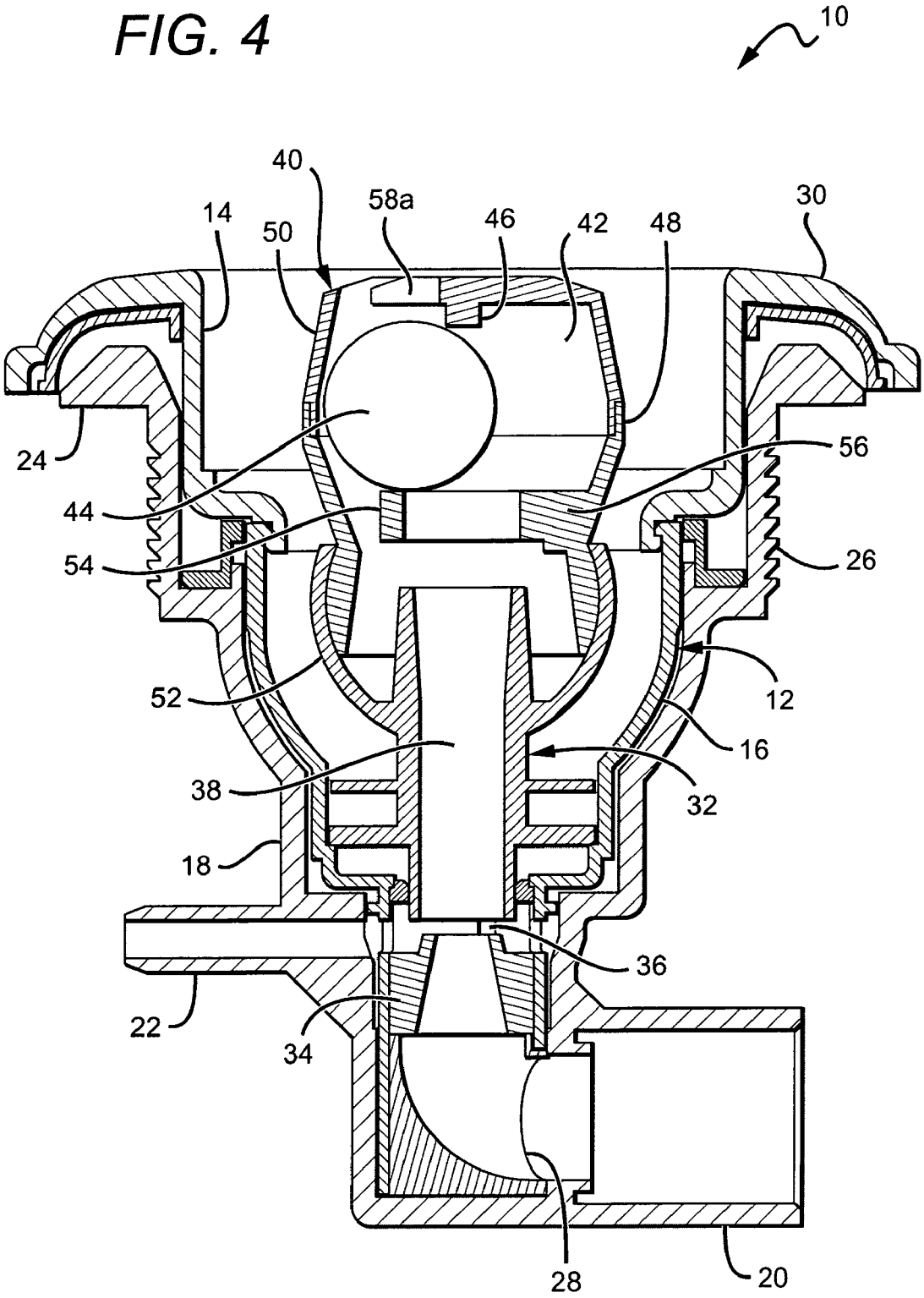
FIG. 4 is a sectional view of the jet shown in FIG. 1, taken along section lines 4/5-4/5 and arranged in an external body.
Figure 8:
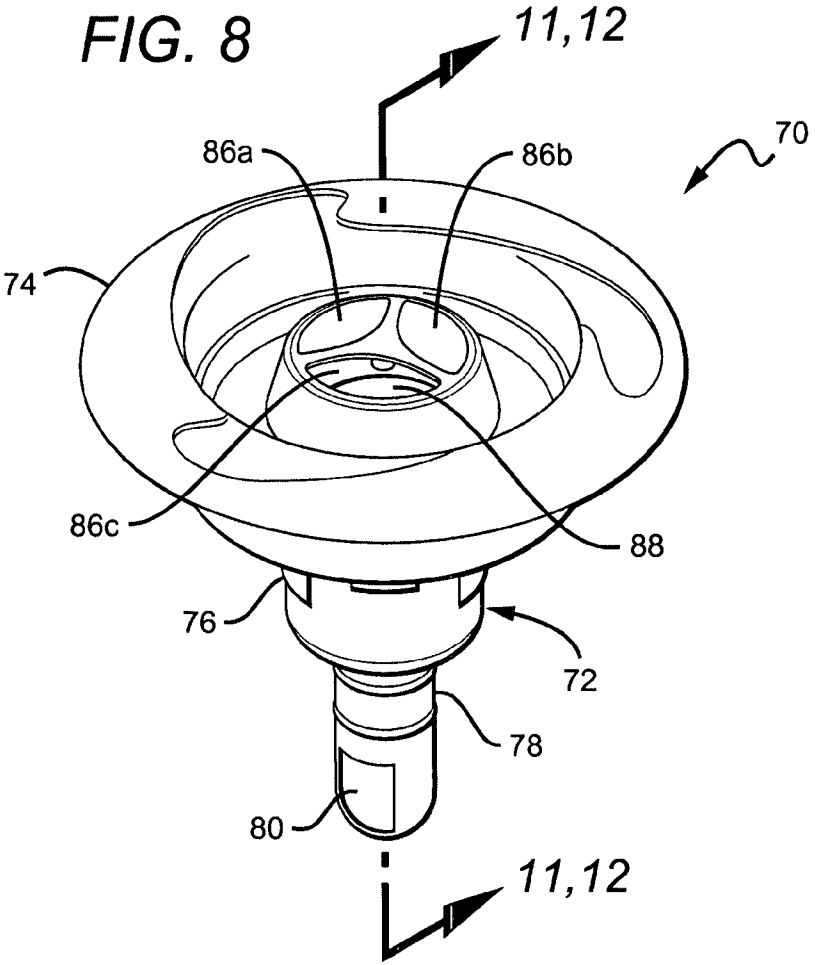
FIG. 8 is a perspective view of a second embodiment of a hydrotherapy jet according to the present invention.
Figure 5:
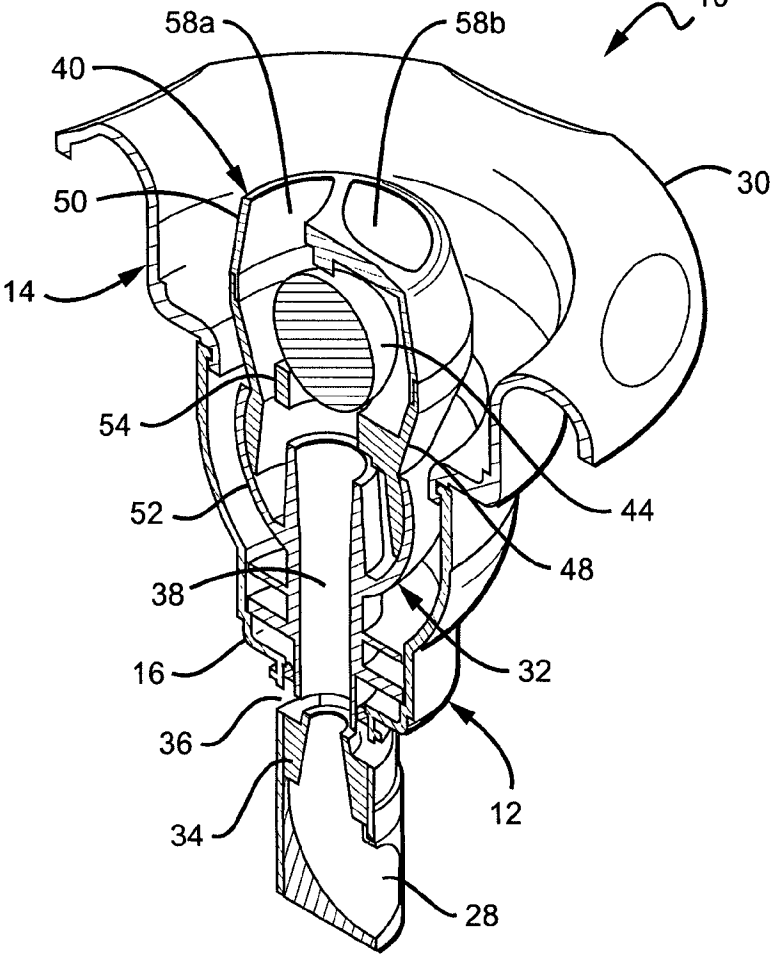
FIG. 5 is a perspective sectional view of the jet shown in FIG. 1 taken along section lines 4/5-4/5.
Figure 10:
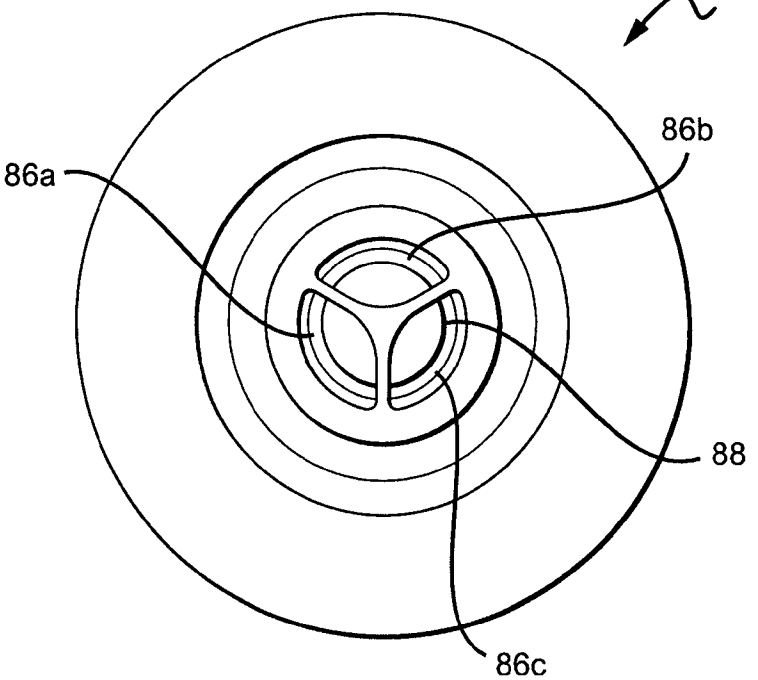
FIG. 10 is a top view of the jet shown in FIG. 8.
Figure 9:
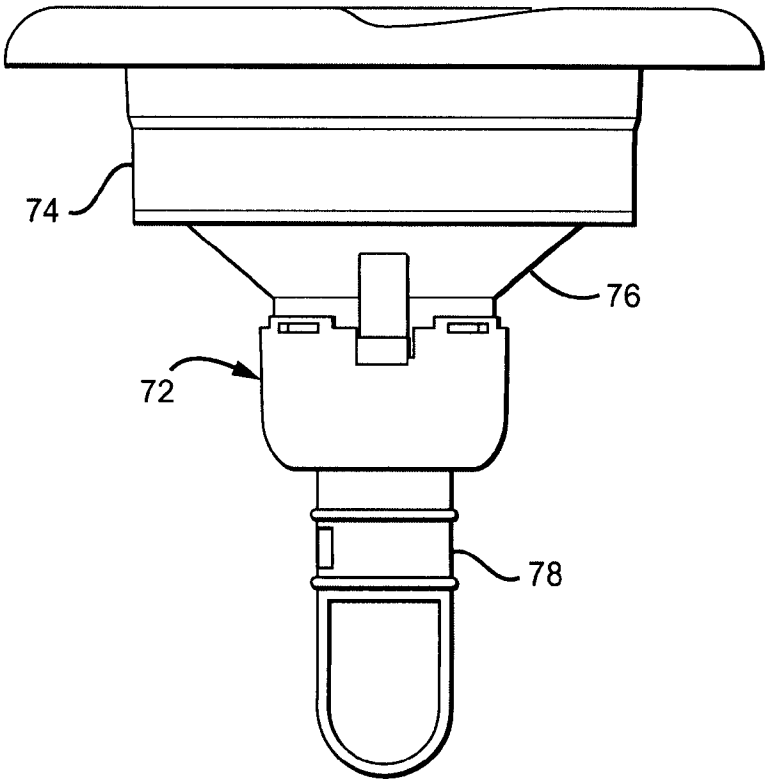
FIG. 9 is an elevation view of the jet shown in FIG. 8.
Figure 12:
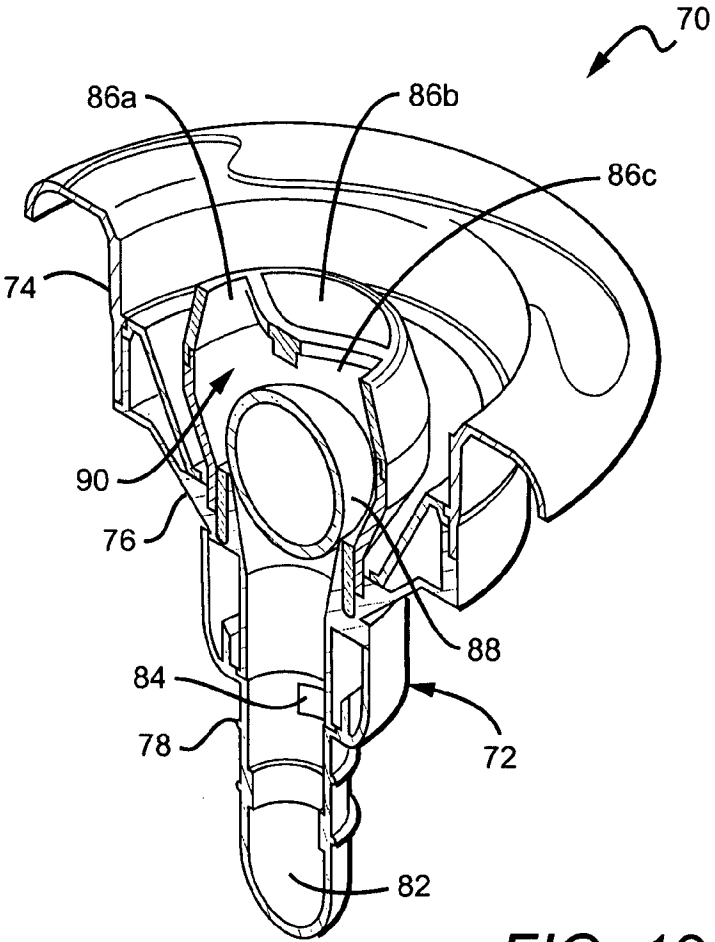
FIG. 12 is a perspective sectional view of the jet shown in FIG. 8 taken along section lines 11/12-11/12.
Figure 11:
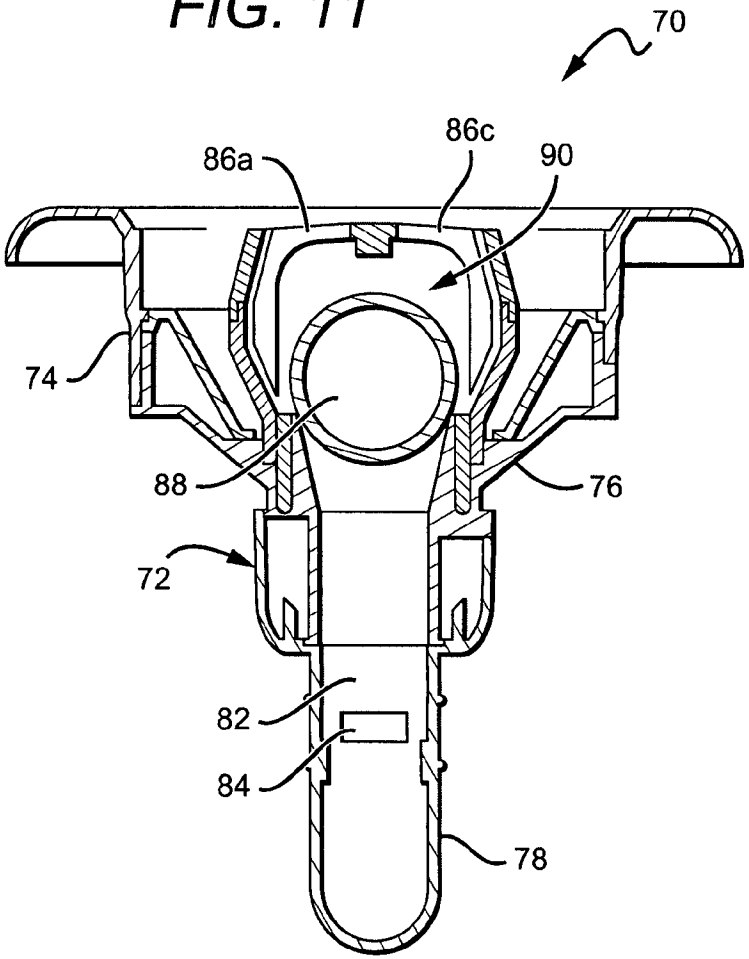
FIG. 11 is a sectional view of the jet shown in FIG. 8 taken along section lines 11/12-11/12.

The jet 10 comprises a generally cylindrical inner body 12 that can be formed of a single construction or can, as shown, comprising an upper inner body portion 14 coupled to a lower inner body portion 16. As shown in FIG. 4, the inner body 12 can be mounted in an outer body 18 that can comprise a water connecting conduit 20 that receives a standard water supply tube to supply water to the inner body 12. The outer body also has an air inlet 22 to allow air into the outer body 18, and in turn into the inner body 12, in applications where aerated water is desired. Water supply tubes that can be connected to the water conduit 20 can also be connected to the spa's plumbing system, which circulates water between the spa and system's heater, pump and filter, and back to the jets. The air inlet can be connected by conduit to a spa blower, or can be left open to draw ambient air into the jet 10.

As further shown in FIG. 4, the outer body 18 has an external flange 24 that is arranged such that it is positioned on the spa's water contacting wall when the jet 10 is installed. The outside surface of the outer body 18, adjacent to the flange 24, has a threaded section 26 for mating with the threads of a wall fitting (not shown). A gasket or other devices or compounds that provide a watertight seal (not shown) can be on the spa wall, wall fitting and/or the flange 24 to provide a watertight seal between the wall and jet 10. The fitting is rotated until the flange 24 tightens against the spa wall. The jet 10 is held securely in place with the spa wall sandwiched between the flange 24 and the fitting.

The inner body 12 comprises a water inlet 28 that operates as an opening to the interior of the inner body 12 to allow water in from the water conduit 20. When the jet 10 is installed in a spa, a spa occupant can control the amount of water that passes into the inner body 12 by grasping the outer flange 30 and applying a turning force to it. This in turn causes the inner body 12 to rotate within the outer body 18, which changes the alignment of the opening 28 with the water conduit 20. When the opening 28 is fully aligned with the conduit 20, the maximum amount of water enters the inner body 12. Moving the opening 28 out of alignment with the water conduit 20 reduces the amount of water entering the inner body 12, and when the opening 28 is moved completely out of alignment with the water conduit 20, no water enters the inner body 12.

In some embodiments the amount of water entering and passing through the inner body by the alignment of the opening 28 and conduit 20 not only impacts the force of the water passing through and leaving the jet 10, but can also impact the rate of pulsing provided by the internal ball. In some embodiments, the greater the force of the stream, the greater the turbulence of the stream and the greater the rate at which the ball moves about the interior of the body. As a result, the pulsating effect of the stream leaving the jet can be increased.

Water entering the inner body 12 passes into a nozzle 32, although in other jet embodiments a nozzle is not included. The interior surface of the nozzle 32 has a venturi section 34 that tapers slightly to accelerate the water flowing through the nozzle 32, causing a venturi effect. Forward of the venturi section 34 are axial air passageways 36. Air entering the outer body 18 through the air inlet 22 can flow to the forward end of the venturi section 34 through the passageways 36. At that location, air is entrained into the water jet due to the venturi action, producing a jet with a desirable water/air mixture.

The water stream (with entrained air) then passes through the nozzle's longitudinal section 38 and into the eyeball 40 that provides a space 42 to hold the internal ball 44. The space 42 and ball 44 can be many different sizes, and in one embodiment the space 42 and ball are sized such that the stream passing into the eyeball 40 strikes the ball 44. The turbulence of the stream entering the eyeball and/or the turbulence created by the stream striking the ball 44 causes the ball to move about within the eyeball. The eyeball has a longitudinal tab 46 that can be aligned with the longitudinal axis of the eyeball 40 and can protrude into the interior of the eyeball 40. The tab 46 prevents the ball 44 from coming to rest at the top of the eyeball 40 under the force of the stream. That is, the ball is forced off center in the eyeball 40 by the tab 46 so that the action of the ball 44 creates the desired pulsating effect.

The eyeball 40 can have many different shapes and sizes and can comprise a single construction or be made of different pieces mounted together. The eyeball 40, as shown in this embodiment, comprises a lower eyeball portion 48 and upper eyeball portion 50, best shown separately in FIGS. 6 and 7 respectively, and as a unit in FIGS. 4 and 5. The nozzle's longitudinal. section 38 has an integral cup 52 that opens toward the eyeball 40. The eyeball's lower portion 48 is mounted within the cup 52 with the end portion of the longitudinal section within the lower portion 48. The hourglass shape of the lower portion 48 allows a spa user to move the eyeball within the cup 52 to change the direction of the pulsating stream leaving the eyeball 40. This provides directional control of the stream leaving the eyeball 40.

The lower portion 48 has an internal ring 54 held along the longitudinal axis of the lower portion 48 by extensions 56. The ring is sized such that the ball 44 cannot pass through it, and at least part of the stream from the longitudinal section 38 passes through the ring 54 and strikes the ball 44. The upper portion 50 generally provides the jet outlet and as shown has three openings 58*a-c*, although in other embodiments according to the invention it can have more or fewer openings. The openings 58*a-c* cooperate with the movement of the ball 44 to provide a pulsating stream from each of the openings. When the stream strikes the ball 44, turbulence causes the ball to move about within the eyeball 40 causing at least partial blockage of one or more of the openings. As the ball 44 continues to move about it can provide less or more blockage at any one of the openings 58*a-c*, and this continued motion of the ball 44 causes pulsating streams to exit from the openings 58*a-c* and enter the spa.

The ball 44 in jet 10 is not attached to the remainder of the jet body 12, the eyeball 40, or any other components of the jet 10. It is understood, however, that in other embodiments, the ball 44 could be attached to one of the jet components and still be movable within the jet to generate a pulsating stream. Many different attachment methods could be used such as cord, lead, bracket, etc.

FIGS. 8-12 show another embodiment of a jet 70 according to the present invention also having an internal ball arranged so that the jet outlet provides a pulsating stream. The jet 70 comprises an inner jet body 72 that can be a single construction or can be multiple sections mounted together. The inner body 72 can be mounted in a rotatable arrangement in an outer body in a similar arrangement to the one shown in FIG. 4 and described above. As shown the inner jet body 72 comprises an upper body 74, middle body 76, and lower body 78 mounted together to form the jet body 72. The body 72 comprises a water inlet 80 to allow water into the body 72 and a longitudinal nozzle 82 that allows a stream of water to flow through the body 72. The nozzle 82 has at least one axial air passageway 84 to allow air into the stream to provide the desired air/water mixture.

Downstream from the passageway 84 is an outlet 86 having three "pie shaped" openings 86*a-c*. A ball 88 is held in the jet 70 by the outlet 86, with the ball 88 being at least partially in the path of the stream exiting from the nozzle 82. The ball 88 is held and is free to move around the space 90 such that when the stream strikes the ball the turbulence causes the ball 88 to move within the space. This causes the ball 88 to at least partially block the water at one or more of the openings as it moves, generating a pulsating stream to the spa.

The ball 88 is larger relative to its space 90 compared to the ball and space in FIG. 1-5, which limits the amount of movement of the ball 88. This limitation, however, still allows for the generation of a pulsating stream. The jet 70 also does not have an adjustable outlet like the jet 10 in FIGS. 1-5. Instead, the outlet is fixed within the body.

Figure 13:
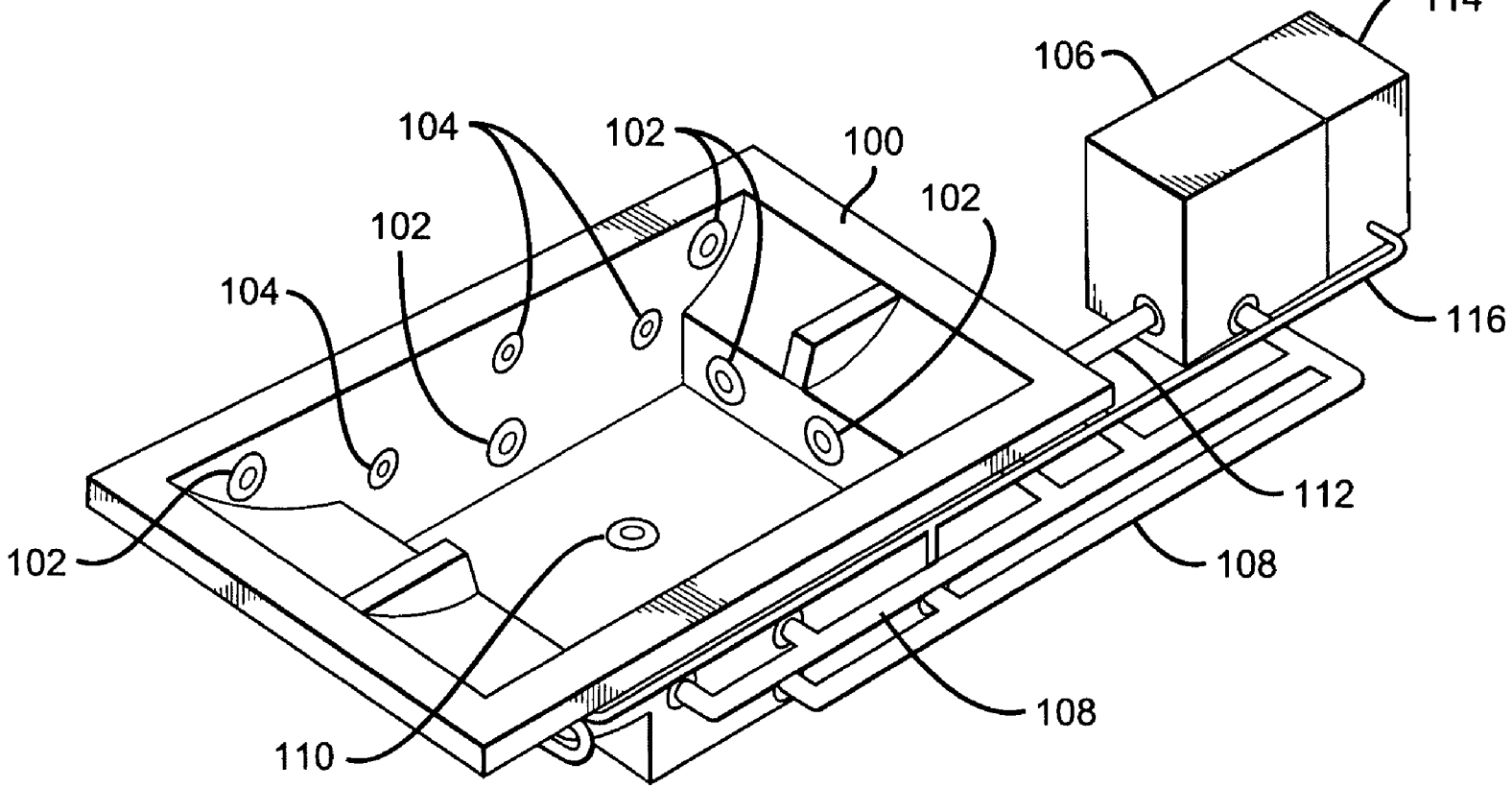
FIG. 13 is a perspective view of one embodiment of a spa system using a jet according to the present invention.

As shown in FIG. 13, multiple jets can be installed in a spa or tub shell 100. Some or all of the jets can be one of the jets according to the present invention as described above, with the jets in this embodiment being jet 102. The remaining jets can be any other desired type, such as a variety of prior single nozzle jets 104. Both types of jets are connected to a water pump 106, used to circulate the water throughout the spa system, by a series of water conduits 108. Water from shell 100 is provided to pump 106 through the drain 110, which is connected through return water conduit 112 to pump 106. Water from pump 106 is provided back to shell 100 by conduits 108, where it flows into jets 102 and 104, as the case may be, and in turn into shell 100, completing the loop. Additionally, an air system 114 can be included that provides air to individual jets 102 and 104 through an air conduit 116, to aerate the water flowing through the jet. The air system 114 can be pump driven to increase the pressure of the air entering the jet 102, or it can be vacuum based with the venturi's located within the jets 102 drawing air into the jets 102 and water flow stream.

Although the present invention has been described in considerable detail with reference to certain preferred configurations, other versions are possible. The invention can be used in spas, pools, tubs and the like. Different spa, pool or tub components can use the invention for water illumination. Therefore, the spirit and scope of the appended claims should not be limited to the preferred versions described above.

I claim:

1. A hydrotherapy jet system that provides a pulsating water stream, comprising:

a jet body which includes a water nozzle, a stream of water flowing through said nozzle, said body including an air inlet for aeration of the stream of water flowing through said nozzle;

a water inlet to said body to allow said stream of water into said body;

a primary water outlet allowing said stream to exit said body;

a ball within said body to block and divert said stream as it flows to said primary outlet; and a solid tab integral with said body and protruding into the interior of said body, said tab arranged to prevent said ball from coming to rest such that the movement of said ball causes said water stream to pulsate as it exits said body through said primary water outlet.

2. The jet of claim 1, further comprising a reservoir of water, wherein said water outlet provides a stream of water to the interior of said reservoir of water.

3. The jet of claim 1, wherein said outlet comprises at least one outlet opening.

4. The jet of claim 1, further comprising an eyeball, said ball held in said eyeball, said ball being moveable within said eyeball.

5. The jet of claim 4, wherein said stream of water passing from said water inlet to said water outlet contacts said ball and causes said ball to move about within said eyeball.

6. The jet of claim 5, wherein said eyeball comprises said tab.

7. The jet of claim 3, wherein movement of said ball causes said ball to at least partially block at least one of said outlet opening, causing at least partial interruption of said water exiting said partially blocked opening.

8. The jet of claim 1, wherein said water nozzle forms a venturi in the water flowing through it.

9. The jet of claim 1, further comprising an eyeball, the water stream exiting said body through said eyeball and said eyeball being movable to change the flow direction of the water stream.

10. The jet of claim 1, further comprising a flange that is rotatable to change amount of water in said stream entering said body.

11. A system for providing a hydrotherapy jet to a reservoir of water, comprising:

a reservoir shell capable of holding water;

a plurality of hydrotherapy jets mounted to the reservoir shell;

a water pump system that circulates water from said reservoir and capable of providing a stream of water to at least one of said jets, said jets having an internal object that moves within said jet to block and divert said stream and a solid tab integral with said jet and protruding into the interior of said jet, said tab arranged to prevent said object from coming to rest such that the movement of said object causes said water stream to pulsate as it exits said jet, said jet providing a pulsating stream to said reservoir.

12. The system of claim 11, further comprising an air system that provides an air intake to each of said jets.

13. The system of claim 11, wherein said object is a ball.

14. The system of claim 11, wherein said at least one of said jets comprises:

a jet body;

a water inlet to allow said stream into said body; and a water outlet allowing said stream to exit said body, wherein said object is a ball located within said body, said stream hitting said ball causing it to move within said body and causing said stream of water to pulsate as it exits said body.

15. The system of claim 14, wherein said at least one of said jets further comprises an eyeball to house said ball, said eyeball being sized to allow movement of said ball within said eyeball.

16. The system of claim 15, wherein said eyeball is movable to change the flow direction of the water stream exiting said body.

17. The system of claim 14, further comprising an inner body portion, said inner body rotatable within said jet body to vary the amount of water in said stream entering said body.

18. The system of claim 14, wherein said body further comprises a water nozzle which forms a venturi in the water flowing through it, said body including an air inlet for aeration of the water flowing through said nozzle.

19. A hydrotherapy jet system that provides a pulsating water stream, comprising:

a jet body comprising a primary water outlet and a water nozzle, a stream of water flowing through said nozzle, said body including an air inlet for aeration of the stream of water flowing through said nozzle;

said stream of water flowing through said jet body, said stream exiting said body through said primary outlet;

a movable object within said jet body to block and divert said stream as it flows to said primary outlet; and a solid tab integral with said jet body and protruding into the interior of said body, said tab arranged to prevent said movable object from coming to rest such that the movement of said object causes said stream to pulsate as it leaves said body.

20. The jet of claim 19, wherein said object comprises a ball.

21. The jet of claim 19, wherein said body comprises a water inlet to allow said stream into said body.

22. The jet of claim 21, wherein said outlet comprises a plurality of outlet openings.

23. The jet of claim 20, further comprising an eyeball held within said body, said ball held in said eyeball and moveable within said eyeball.

24. The jet of claim 23, wherein said stream of water passing from said water inlet to said water outlet contacts said object and causes said object to move about within said eyeball.

25. The jet of claim 22, wherein movement of said ball causes said ball to at least partially block at least one of said outlet openings, causing at least partial interruption of said water exiting from at least one of said openings.

26. The jet of claim 23, wherein said eyeball is movable to change the flow direction of the water stream.

* * * * *